United States Patent [19]

Shibano et al.

[11] 4,237,465

[45] Dec. 2, 1980

[54] MAP PLATE FOR THE ADJUSTMENT OF ANGLE ELEVATION OF AN ANTENNA

[75] Inventors: Yoshizo Shibano, Osaka; Tetsuo Hatano, Takatsuki; Toshihiko Ohkura, Amagasaki, all of Japan

[73] Assignee: Sumitomo Electric Industries, Ltd., Osaka, Japan

[21] Appl. No.: 21,763

[22] Filed: Mar. 19, 1979

Related U.S. Application Data

[63] Continuation of Ser. No. 697,974, Jun. 21, 1976, abandoned.

[30] Foreign Application Priority Data

Jun. 26, 1975 [JP] Japan ..... 50-090335

[51] Int. Cl.[3] ..... H01Q 3/00

[52] U.S. Cl. ..... 343/894

[58] Field of Search ..... 343/DIG. 2, 760, 894, 343/840; 33/264, 268

[56] References Cited

U.S. PATENT DOCUMENTS

| | | | |
|---|---|---|---|
| 1,932,469 | 10/1933 | Leib et al. | 343/839 |
| 3,377,593 | 4/1968 | Sansom | 343/894 |
| 3,510,877 | 5/1970 | Turriere | 343/760 |
| 3,634,939 | 1/1972 | Sorem | 33/1 SC |

*Primary Examiner*—Eli Lieberman

*Attorney, Agent, or Firm*—Carothers and Carothers

[57] ABSTRACT

A map plate for adjusting the angle of elevation of an antenna for use with an artificial satellite communication system is composed of a map in polar coordinates of the area of signal receiving points, a group of equi-angle elevation lines which are drawn on the map, a scale of the angle of elevation which covers the whole area of the signal receiving points, which is given on the circumference of the map, a pointer which is provided on the origin of the polar coordinates and a device connected to said pointer which interconnects the revolution of the pointer to the revolution of the antenna for adjusting the angle of elevation such that the angle of elevation of the antenna will reach a designated value by driving the antenna until the pointer reaches the designated value on the scale.

2 Claims, 11 Drawing Figures

O
R
θ
28°
29°
30°
31°
32°
33°
34°
35°
36°
37°
38°
39°
40°
41°
42°
43°
44°
45°
46°
47°
48°
49°
θu z
y
x
O
P
RE
θp
θu
φp
φs
Rs
S (A = 18)

(A = 1)

(A = 23)

MAP PLATE FOR THE ADJUSTMENT OF ANGLE ELEVATION OF AN ANTENNA

CROSS REFERENCE TO RELATED APPLICATION

This is a continuation of patent application Ser. No. 697,974 filed June 21, 1976, now abandoned, for Map Plate For The Adjustment of Angle of Elevation Of An Antenna.

BACKGROUND OF THE INVENTION

The present invention relates to a map plate for adjusting the angle of elevation of a signal receiving antenna to the direction of an artificial satellite.

When a radiated electromagnetic wave of an artificial satellite is received on the ground, it is necessary to use an antenna of very high gain.

In order to have the direction of the pattern of such an antenna aimed directly at the satellite, it is necessary to carry out very careful scanning in the horizontal and vertical directions and set the antenna in such a position as to obtain the maximum signal receiving level.

Two dimensional scanning is extremely difficult. In order to overcome these difficulties, various types of automatic tracking systems have been specially developed for large scale receiving group stations.

Such a large scale tracking system, however, is not applicable for economic reasons in cases where an electromagnetic wave sent from a satellite is received by a terminal station of a CATV communication system or directly by an individual household or the like in a small scale system.

In consequence, a simple and economical system for adjusting the direction of an antenna is required.

When a signal receiving point on the ground is designated, it is possible to accurately calculate its angle of elevation to such a stationary satellite. If the angle of elevation of the antenna can be preset by a simple method with an error not in excess of the main beam angle of the antenna, then it is considered that the reception of the electromagnetic wave of the satellite will be assured by adjusting the horizontal angle of the antenna so as to obtain the maximum receiving level.

Therefore it is equally possible to get the direction of the antenna to coincide with the direction of the satellite with perfect accuracy by first scanning the horizontal angle to find the direction of maximum reception and then by adjusting the angle of elevation.

In this way, the systematic adjustment of the antenna may be done quickly and easily.

Since the receiving antenna used in the present case is a parabolic antenna with a diameter of about 0.6–4 m, the range of tolerable error of the preset angle becomes approximately ±0.3° in cases where the highest frequency band of 12 GHz alloted to satellite communication is used.

We will propose a simple map plate for adjusting the angle of elevation of an antenna so as to direct it correctly at a satellite with an error within the afore-mentioned permissible range. The map plate of the present invention is suitable for use by a simple signal receiving system of an artifical satellite communication system.

SUMMARY OF THE INVENTION

The object of the present invention is to provide a map plate for adjusting the angle of elevation of an antenna, which is comprised of a map of the area of the signal receiving points drawn in polar coordinates, a group of equi-angle elevation lines with suitable spacing drawn on the map, a scale of the angle of elevation of the whole area of the map provided around the map and a pointer provided on the origin of the map interconnected mechanically in such a manner that when the pointer indicates the value of the angle of elevation of a receiving point, the antenna is directed to the designated satellite.

BRIEF EXPLANATION OF THE DRAWINGS

FIG. 10(*b*) illustrates the map plate fixed to the antenna shown in FIG. 10(*a*).

DETAILED DESCRIPTION OF THE INVENTION

First, the map plate of the satellite angle of elevation will be explained. Referring to the coordinates shown in FIG. 1, if the x axis is taken in the longitudinal direction O and the Z axis in the direction of the north pole, the angle of elevation $\theta_u$ looking up at the satellite S from a receiving point P on the ground will be given as follows:

$$\sin \theta u = \frac{\cos \theta_p \cos (\phi_p - \phi_s) - \frac{R_E}{R_s}}{\sqrt{1 + (\frac{R_E}{R_s})^2 - 2\frac{R_E}{R_s} \cos \theta_p \cos (\phi_p - \phi_s)}} \quad (1)$$

where $\phi_p$, $\theta_p$ are the longitude and latitude of point P respectively, $\phi_s$ the latitude of the satellite, $R_E$ the radius of the earth, and $R_s$ the distance from the center of the earth to the satellite. Of these, $R_s$, $\phi_s$ and $R_E$ are known values. Therefore, if the longitude and latitude $\phi_p$, $\theta_p$ of the receiving point P are given in formula (1), the angle of elevation $\theta_u$ at point P can be calculated.

Figures 1, 2:
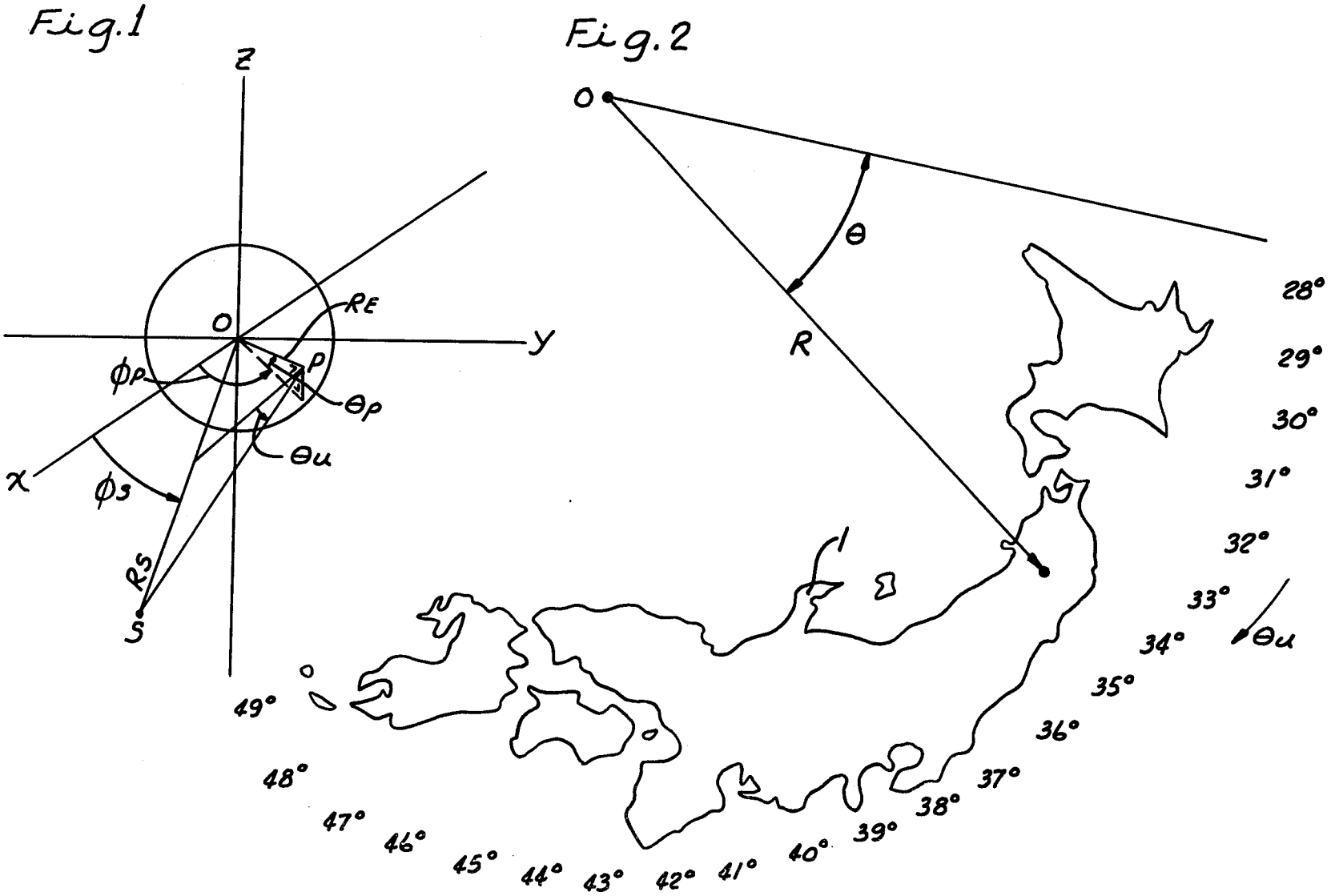
FIG. 1 is a diagram of the angle of elevation at a signal receiving point looking up at an artificial satellite.
FIG. 2 is a map of a signal receiving area drawn in polar coordinates.

In FIG. 2, a contour map is drawn in polar coordinates in which the relationship represented by the formula below is established between the angle $\theta$ and the afore-mentioned angle of elevation $\theta_u$.

$$\theta - \theta_o = A\,(\theta_u - \theta_{uo}), \quad (2)$$

where

A = arbitray constant $\theta_o$, $\theta_{uo}$ = suitably determined constant values.

Next, if $\theta_p$, $\phi_p$ are given in formula (1) over the whole of the signal receiving area considered (for instance, the whole area of Japan), $\theta_u$ is obtained with respect to the given $\theta_p$ and $\phi_p$ from formula (1), and $\theta$ is also obtained from formula (2). A map of the signal receiving area is drawn in polar coordinates as shown in FIG. (2). At this time, the radial component R may be selected arbitrarily. The map obtained in this way is such that the angle of rotation $\theta$ around the origin O of the coordinates is proportional to the angle of elevation $\theta_u$ in accordance with formula (2). This map is called a satellite angle of elevation map.

The map changes in accordance with the value of the constant A of formula (2).

Figure 4:
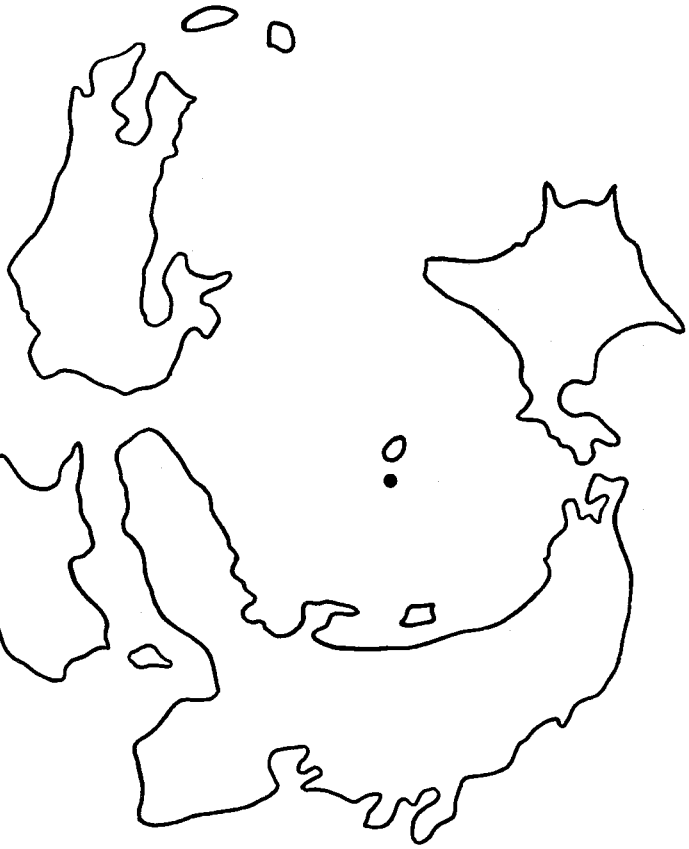
FIGS. 3, 4 and 5 show three kinds of maps of a signal receiving area.
Figure 3:
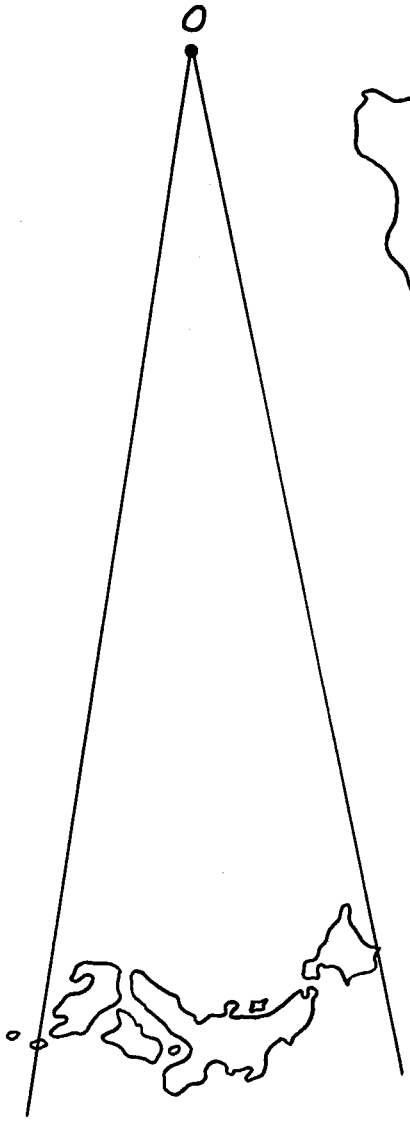
Figure 5:
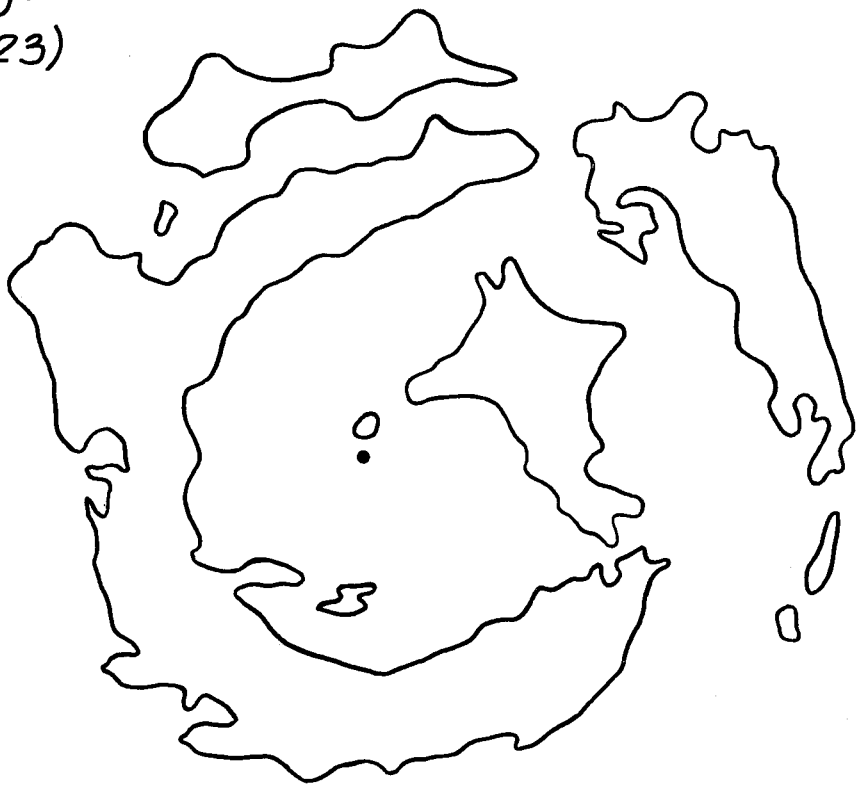

For instance, three kinds of maps of Japan for three values of A (A=1, A=18 and A=23) are given in FIGS. 3, 4 and 5 respectively. If a large value of A is chosen, then a map of whirlpool shape is produced.

Here the map was made on the assumption that $R_E=6378$ km, $R_s=42000$ km and $\phi_s=110°$.

If the selected value of A is not suitable, the configuration of the country of the map is extremely distorted and it becomes very difficult to find the signal receiving point on the map.

Now a map plate for an embodiment of the present invention will be explained in detail.

Figure 6:
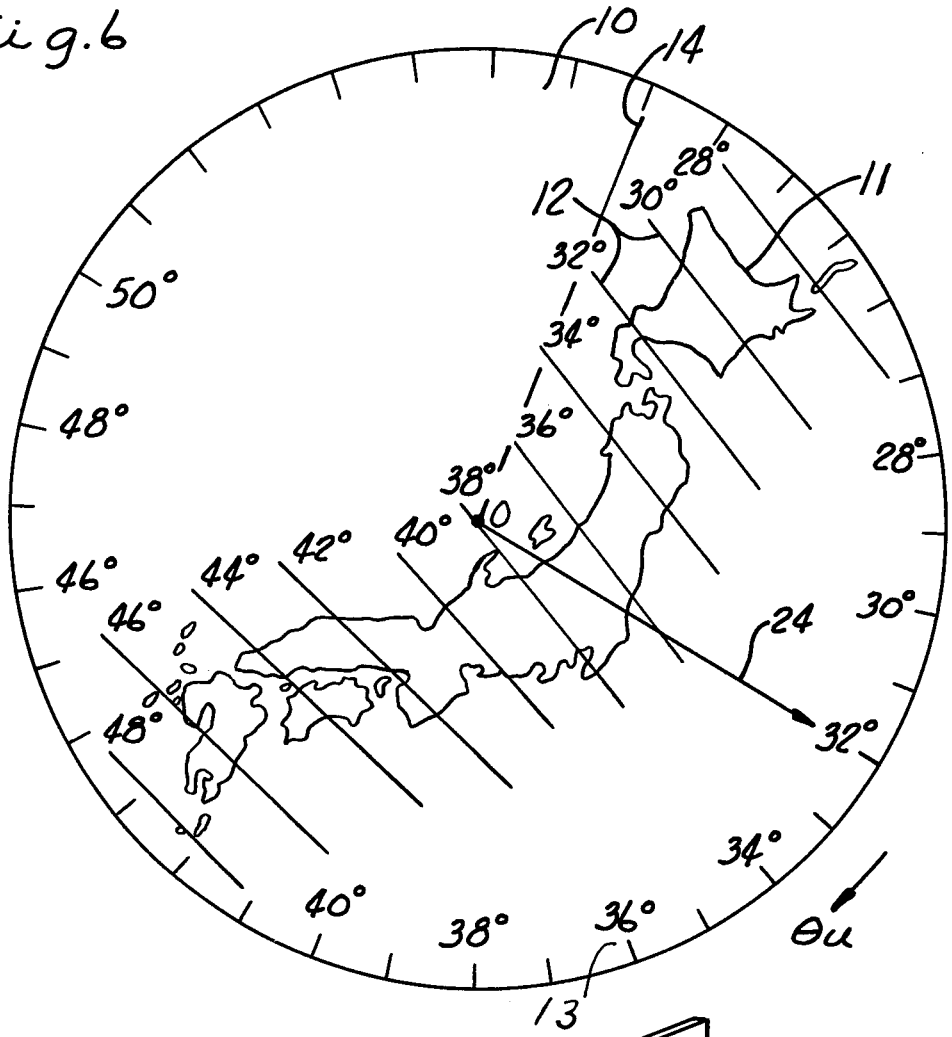
FIG. 6 is a map plate of the present invention.

FIG. 6 shows a map of Japan having a group of equi-angle elevation lines with a spacing of 2 degrees.

In FIG. 6, O is the origin of the polar coordinates of the map, 10 is a map plate, 11 is a map of Japan, 12 is a group of equi-angles elevation lines with spacing of 2 degrees, and 13 is a scale of the angle of elevation which is provided around the circumference. On the map plate 10, 14 is a line giving the angle $\theta_{uo}'$ on the polar coordinate, and 24 is a pointer provided on the origin. The pointer 24 is connected to a device which gives the antenna the real angle of elevation $\theta_u$.

The group of equi-angle elevation lines are calculated from formula (1) and plotted on map 10. The scale 13 gives the value of $\theta_u$ over the whole area of the map. The value of $\theta_u$ on scale 13 is related to the angle $\theta$ in accordance with formula (2).

Next we will explain the method for adjusting the angle of elevation of a receiving antenna using a map plate of the present invention whereby the direction of the receiving antenna is easily preset to a required direction.

Figure 7:
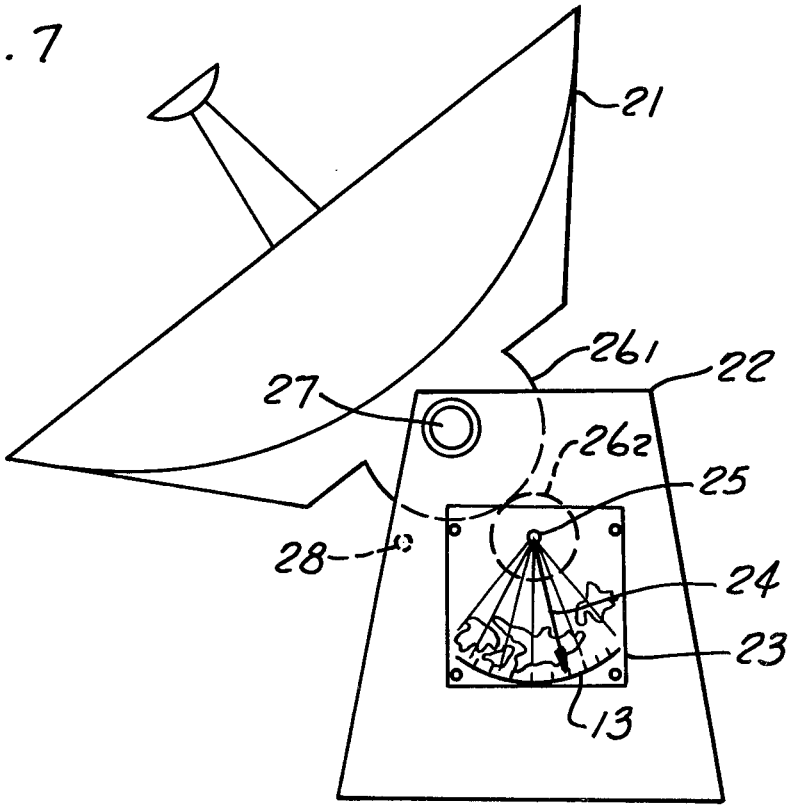
FIG. 7 illustrates an apparatus for adjusting the angle of elevation of an antenna using the map plate of the present invention.

FIG. 7 is a side view for explaining the structure of the apparatus for adjusting the angle of elevation of an antenna of the present invention. As is shown in FIG. 7, the antenna 21 is mounted on the supporting stand 22 and is movable in the direction of elevation by means of an axle of revolution 27.

The satellite angle of elevation map 23 as illustrated in FIGS. 3, 4, and 5 is fixed on stand 22, and the axle of revolution 25 of pointer 24 is provided at the origin O of the polar coordinates of the map.

The axle of revolution 25 of the pointer 24 is connected with the axle of revolution 27 of the antenna by means of a suitable mechanical coupling device, for example, a set of gears, $26_1$ and $26_2$. 28 denotes a stopper for limiting the movement of the antenna. The angle of elevation of the antenna is $\theta_{uo}'$ when the antenna stops at the stopper 28.

The revolution ratio between gears $26_1$ and $26_2$ is made equal to the value of A in formula (2).

The pointer 24 must be fixed beforehand to the axle of gear $26_2$ so that when the antenna 21 stops at the stopper 28 at the angle of elevation $\theta_{uo}'$, the pointer 24 indicates the angle $\theta_{uo}'$ on the scale 13.

When the pointer 24 is brought to a value of $\theta_u$ on the scale, the angle of elevation of the antenna is made $\theta_u$.

In consequence, we find a value for the angle of elevation of the signal receiving point from among the angle of elevation lines on the map and if we adjust the antenna so that the pointer indicates the value of $\theta_u$ on the scale, the antenna will be correctly pointed in the direction of the angle of elevation $\theta_u$.

Accordingly, if the antenna has been adjusted beforehand to receive the maximum signal in the horizontal direction, we can point the antenna in the direction of the satellite to obtain the maximum signal receiving level.

Figure 8:
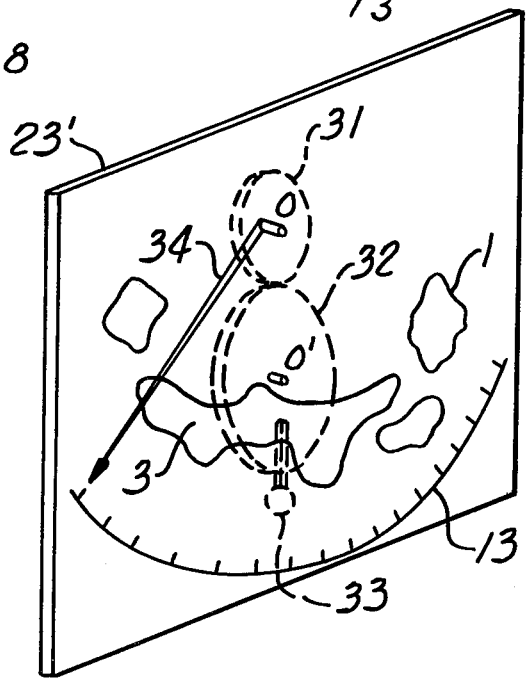
FIG. 8 illustrates a map plate of another embodiment of the present invention.

FIG. 8 illustrates a map plate of another embodiment of the present invention. In FIG. 8, a map 1 of a whole area of signal receiving points, for example, Japan is drawn in polar coordinates of the map plate 23'. A gear 31 whose axle is placed at the origin O of the polar coordinates and another gear 32 which is coupled with gear 31 with a determined revolution ratio is provided at an arbitrary place on the map plate 23'. A gravity weight 33 is provided on the circumference of gear 32 so as to drive gear 32 with gravitational force in such a manner that when the map plate is held in a vertical plane and inclined at some angle in the vertical plane, gear 32 rotates the same angle with respect to the map plate, the gear 31 is rotated with the gear 32 through an angle which is determined by the revolution ratio of gears 31 and 32.

Figure 9:
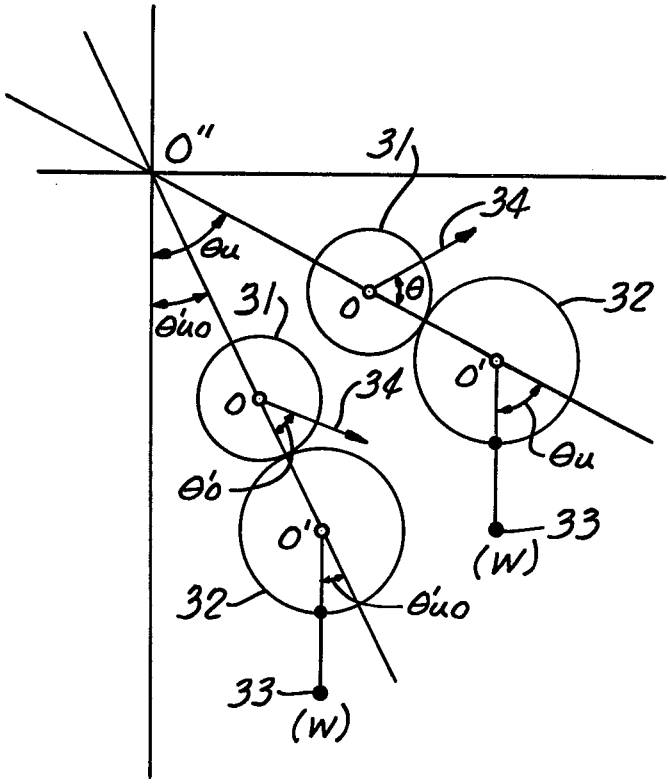
FIG. 9 is a diagram which explains the mutual movement of the interconnecting device.

The movement of gears 31 and 32 is explained in FIG. 9. In FIG. 9, when a straight line $\overline{OO'}$ which passes through the center O of gear 31 and the center O' of gear 32 inclines $\theta_{uo}'$ with respect to the vertical axis and then is rotated around a point O'' on a vertical axis to the place where the inclination with respect to the vertical axis becomes $\theta_u$, the angle between the straight line $\overline{OO'}$ and the line of the direction of gravity $\overline{O'W}$ is changed from $\theta_{uo}'$ to $\theta_u$ in accordance with the inclination of line $\overline{OO'}$ and at the same time the angle with respect to the line $\overline{OO'}$ of the pointer 34 provided on the gear 31 changes from $\theta_o'$ to $\theta$ in accordance with the revolution ratio of the gears 31 and 32. The above explanation shows that formula (2) $\theta-\theta_o'=A(\theta_u-\theta_{uo}')$ is established between $\theta$ and $\theta_u$ and the revolution ratio between gears 31 and 32 is A.

Figure 10A:
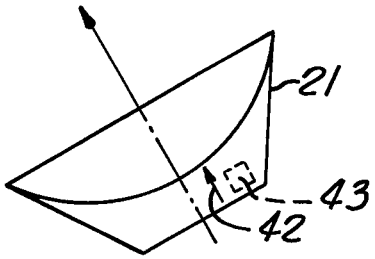
FIG. 10(*a*) illustrates an antenna equipped with a map plate of the present invention.
Figure 10B:
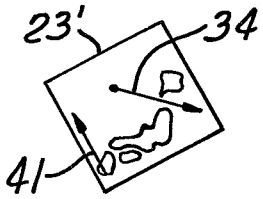

FIG. 10(*a*) illustrates a section of an antenna to which a map plate as shown in FIG. 8 should be fixed in accordance with the designated direction.

In FIG. 10(*a*), 21 is an antenna, 42 is the direction of the axis of the antenna. 43 is the place where map plate 23 should be fixed. FIG. 10(*b*) illustrates a map plate as shown in FIG. 8 held in a vertical plane with the designated inclination.

In FIG. 10(*a*), if the antenna on which the map plate 23' is fixed at the designated place 43 is adjusted beforehand so that the pointer 34 indicates $\theta_{uo}'$ on the scale 13 when the axis of the antenna 42 is oriented to the direction $\theta_{uo}'$, then when the antenna is directed to the angle of elevation $\theta_u$, the pointer 34 indicates the same value on the scale. Accordingly, if we find the angle of elevation of the signal receiving point on the map plate and drive the antenna so as to bring the pointer 34 to the value found on the scale, the antenna will be correctly oriented in the direction of the angle of elevation.

The step-by-step manner of operation of the embodiment illustrated in FIGS. 8 through 10(*b*) is identical to that of the operation discussed in connection with the embodiment of FIG. 7. The only difference between the two embodiments is that the embodiment of FIG. 7 utilizes a gear drive as the means to connect the pointer to the revolutions of the antenna and in the embodiment of FIGS. 8 through 10(*b*), the means to connect the pointer to the revolutions of the antenna is the weighted gear arrangement 31 and 32 in conjunction with the fact that the map plate is mounted to the moving antenna itself as opposed to the stationary mount for the antenna 21. However, the step-by-step operation is identical.

As is apparent from the maps drawn in polar coordinates of the aforementioned examples, the configurations of the maps of Japan are greatly deformed. It is usually very difficult to find the signal receiving point of the antenna on the map. In cases where the map is Japan, however, it is not so difficult to find because the configuration of Japan is lengthy from north to south and its configuration is distinguishable. It is obvious that it can be made still easier to find the signal receiving point by drawing the names of administrative districts, rivers, mountain ranges, cities, etc. on the map.

What we claim is:

1. An antenna and map plate combination for adjusting the angle of elevation of the antenna which comprises a contour map of polar coordinates of an area of signal receiving points; a group of equi-angle elevation lines on said map; a scale of the angle of elevation which covers the whole area of signal receiving points and which is given on a circumferential portion of said map; a pointer which is provided on the origin of the polar coordinates and rotates around said origin to indicate the values of said scale; means connected to said pointer for inter-connecting the revolution of the pointer to the revolution of an antenna for adjusting the angle of elevation of the antenna, which is found among the group of equi-angle elevation lines on the map, such that the angle of elevation of the antenna will attain the value of the angle of elevation for the point where the antenna is geographically placed in the area of receiving points by driving the antenna until the pointer attains a value on said scale corresponding to that value at which the antenna is placed; and wherein said map plate is fixed to a stand of the antenna and means connected to said pointer is composed of a set of gears $a_1$ and $a_2$ whose revolution ratio is made A which is given by the formula below, one of said gear $a_1$ being connected to the pointer and the other $a_2$ connected to the antenna, $$\theta-\theta o'=A\ (\theta u-\theta uo')$$

where $\theta$ is an arbitrary angle, $\theta u$ is the angle of elevation of an antenna, $\theta o'$ and $\theta uo'$ are arbitrary constants.

2. An antenna and map plate combination for adjusting the angle of elevation of the antenna which comprises a contour map of polar coordinates of an area of signal receiving points; a group of equi-angle elevation lines on said map; a scale of the angle of elevation which covers the whole area of signal receiving points and which is given on a circumferential portion of said map; a pointer which is provided on the origin of the polar coordinates and rotates around said origin to indicate the values of said scale; means connected to said pointer for inter-connecting the revolution of the pointer to the revolution of an antenna for adjusting the angle of elevation of the antenna, which is found among the group of equi-angle elevation lines on the map, such that the angle of elevation of the antenna will attain the value of the angle of elevation for the point where the antenna is geographically placed in the area of receiving points by driving the antenna until the pointer attains a value on said scale corresponding to that value at which the antenna is placed; and wherein said map plate is fixed on the antenna and said means connected to said pointer is composed of a set of gears $a_1$ and $a_2$, one of which $a_1$ is connected to the pointer and the other $a_2$ which is free to rotate and can be placed anywhere on said map, gear $a_2$ is provided with a gravity weight on its circumference so as to drive the gear $a_1$ so that the pointer is pointing at the desired value on the scale, and the revolution ratio between gears $a_1$ and $a_2$ is made A which is given by the formula below, $$\theta-\theta o'=A\ (\theta u-\theta uo'),$$

where $\theta$ is an arbitrary angle, $\theta u$ is the angle of elevation of the antenna, $\theta o'$ and $\theta uo'$ are arbitrary constants.

* * * * *